US006961960B2

(12) United States Patent
Gold et al.

(10) Patent No.: US 6,961,960 B2
(45) Date of Patent: Nov. 8, 2005

(54) HIGH STRENGTH IMPACT RESISTANT HAND PROTECTOR

(76) Inventors: Jerome Gold, 3632 Walnut Hill Rd., Virginia Beach, VA (US) 23452; Peter Krajian, 1400 Jefferson St. #3, Chesapeake, VA (US) 23324

( * ) Notice: Subject to any disclaimer, the term of this patent is extended or adjusted under 35 U.S.C. 154(b) by 115 days.

(21) Appl. No.: 10/718,250

(22) Filed: Nov. 18, 2003

(65) Prior Publication Data

US 2005/0102726 A1 May 19, 2005

(51) Int. Cl.[7] ..... A41D 13/00
(52) U.S. Cl. ..... 2/20; 2/16; 2/163
(58) Field of Search ..... 2/16, 19, 20, 159, 2/161.1, 161.2, 163, 167, 169

(56) References Cited

U.S. PATENT DOCUMENTS 4,911,433 A * 3/1990 Walker et al. ..... 482/105
5,345,609 A * 9/1994 Fabry et al. ..... 2/20
5,640,712 A * 6/1997 Hansen et al. ..... 2/20
5,898,938 A * 5/1999 Baylor et al. ..... 2/20
6,105,162 A * 8/2000 Douglas et al. ..... 2/20
6,119,271 A * 9/2000 Byon ..... 2/161.2

* cited by examiner

*Primary Examiner*—Tejash Patel
(74) *Attorney, Agent, or Firm*—Foley & Lardner LLP

(57) ABSTRACT

A multilayer body system, adapted for use in protective sports equipment, is described which comprises in combination in sequence a center core layer of a lightweight high strength impact resistant material layer, a first layer of a foam type padding entirely surrounding and bonded to the inner core layer, a second layer of a padding type material layer completely surrounding and enclosing the inner layers, thus acting as an outer cover layer, of which the two layers are then securely stitched at their periphery. The construction method described herein also ensures that the inner layers are securely held in place and thus immobilized from unexpected and unwanted movement within the embodiment. Also the padding construction ensures safety and comfort.

4 Claims, 1 Drawing Sheet

HIGH STRENGTH IMPACT RESISTANT HAND PROTECTOR

BACKGROUND

The present invention relates to a high strength impact resistant hand protector. Hand protectors offered today offer only adequate protection due to their lack of impact absorbing material composition and design. When such hand protectors are utilized during sports that demonstrate the risk of high impact blows occurring, the protection provided by such devices do not allow the appropriate impact dissipation characteristics to the hand and fingers, due to the materials used which are fabric based, or interwoven metal mesh fabric, which are limited to their impact absorbing capabilities. The hand protectors is utilized in situations where high impact dissipation is a concern such as in sports, i.e baseball, more particularly when worn by a baseball player attempting to hit a baseball (at bat). Oftentimes when a baseball players hand is struck, the hand protectors presently offered do not appropriately or effectively dissipate the needed amount of impact energy, that would sufficiently reduce impact energy to the hand and fingers, consequently oftentimes causing painful and serious injuries. The hand protectors differ only in design and style, and not in the area of optimal impact protection qualities, which in turn offers the wearer minimal and limited protection of an athletes hand and fingers due to the lack of impact absorbing characteristics offered by such hand protectors. Prior art devices do not provide for a maximum protection hand protector that permits above and adequate impact absorption dissipation to the hand and finger areas when struck by impact force.

BRIEF SUMMARY

The present invention is directed to a hand protector for dissipating impact energy formed from incoming objects that may strike the hand of the wearer. The hand protector includes a high strength lightweight impact resistant material (titanium, aluminum, steel, hard plastics, leather, nylon, padding) or any other similar type materials thereof. The high strength lightweight impact resistant material is positioned to cover the area of the back of the hand and finger areas, and is designed to absorb incoming impact energy. The impact resistant material is retained to the hand protector by being pocketed and enclosed within the outer layers of leather/nylon, or similar type materials, and the inner layer of padding material, and then is machine stitched within the two layers, and in turn is completely and securely enclosed. The hand protector of the present invention permits free movement of the hand and fingers, without any mobility impaired. The high strength lightweight impact resistant material is fully pocketed and enclosed within a padded enclosure to ensure safety and comfort. These and other aspects of this invention are further illustrated in the accompanying drawings, and are described in full in the following specifications.

BRIEF DESCRIPTION OF THE DRAWING

The invention may take certain parts and arrangements of parts, a preferred embodiment of which will be described in detail in this specification, and illustrated in accompanying drawings which form a part hereof.

DETAILED DESCRIPTION

Figure 1:
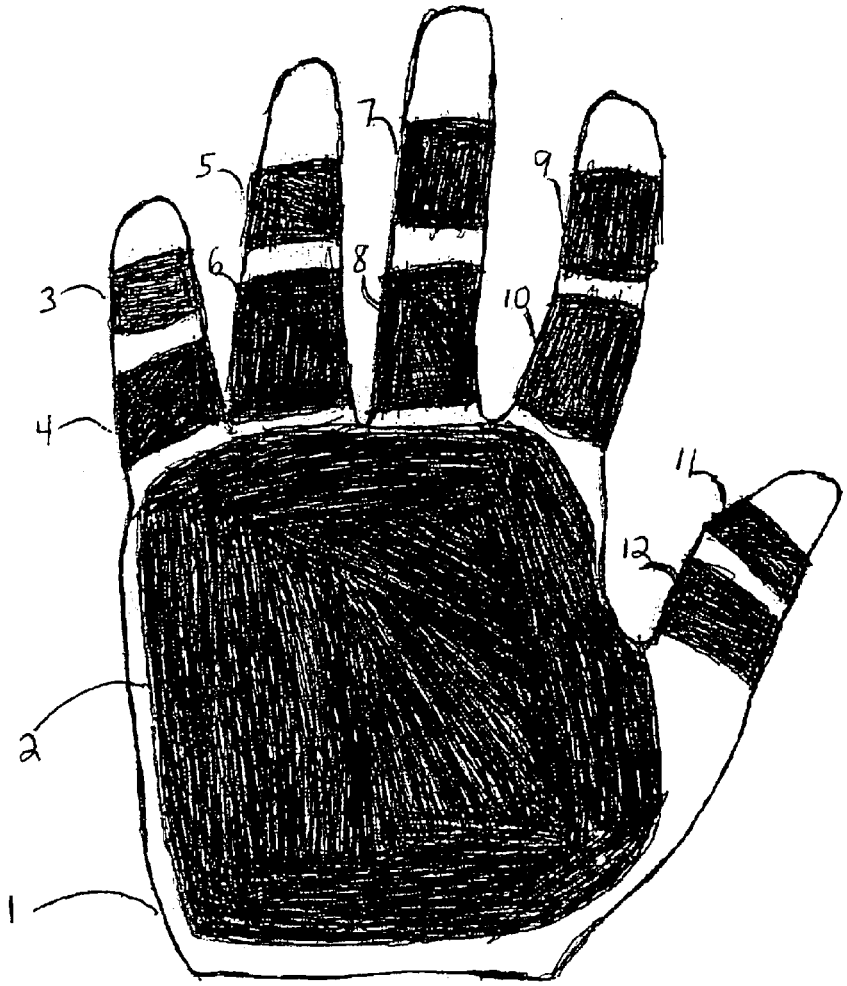
FIG. 1, is a perspective view of the hand protector in accordance with the present invention.
Figure 2:
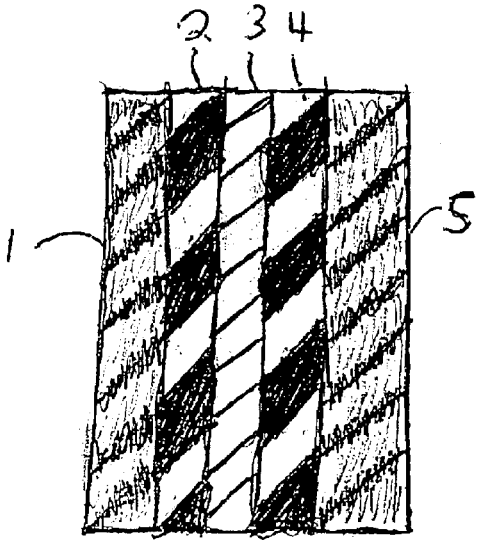
FIG. 2, is a perspective view of the material composition of the individual pocket enclosures machine stitched onto the surface of the hand protector.

Referring now to the drawings and more particularly to FIG. 1. There is shown an embodiment of a high strength impact resistant hand protector manufactured utilizing the method of the present invention. In the embodiment shown, the hand protector consists of a outer layer (1) which is comprised of a leather, nylon or similar type materials thereof. The leather outer layer is stitched to form a pocket for receiving the material and padding of which will be described hereinafter. FIG. 2 illustrates a cross sectional view of the enclosed pocket enclosures stitched onto the hand protector comprised of multiple layers of materials which will be referred and referenced to in detail hereinafter. FIG. 2 allows the view of the materials utilized to form the hand protector. The outer cover layers (1,5) consist of a leather material or similar type materials thereof as shown in FIG. 2. The outer layers (1,5) are cut and stitched to form a pocket enclosure for receiving the high strength lightweight material and padding. Sections (2,4) as shown in FIG. 2 consist of padding or foam type material(s) thereof. The cover layer of foam type material(s) of sections (2,4) is utilized to dissipate impact energy received from the outer cover layer (1), before reaching the inner layer of high strength lightweight impact resistant material (3) of the pocket enclosure. The foam type material (2,4) are stitched to the inner surface of the outer cover layers (1,5) to conform together cohesively, and then are stitched in a manner to form a pocket enclosure(s) for receiving the lightweight/high strength impact resistant material (3). The impact material (3) is fully enclosed within the pocket(s) and is then stitched by forming a permanent enclosure.

FIG. 1 illustrates the outer cover of a glove that is sufficient to fit the human hand. The glove is made of any fabric, leather, nylon, or any other similar type material thereof. FIG. 1 illustrates pocket type enclosures (2–12) being positioned on the back of the hand. Each of the first individual pocket enclosures (4, 6, 8, 10, 12) covering the respective areas of each of the fingers and the thumb are positioned between the knuckles and the first finger joint adjacent thereto. Furthermore, each of the second individual pocket enclosures (3, 5, 7, 9, 11) covers the respective areas of each finger between the second finger joint being adjacent to a distal end thereof and the first finger joint. Further, the second individual pocket with respect to the thumb is positioned between the first finger joint and distal end thereof as shown in FIG. 1.

The first and second pocket enclosures are formed specifically to receive the high strength lightweight impact resistant material. Foam or a foam type material (2,4) is directly layered onto the inner surface of the outer cover layers (1,5) to conform together of which the layers are then formed and stitched into a pocket type enclosure with an opening sufficient to receive the high strength lightweight impact material (3). The opening of the individual formed pocked are stitched to enclose the impact material therein. Furthermore, the respective individual pocket enclosures (3–12) on each of the fingers and the thumb extends side to side as shown in FIG. 1. Also, a third enclosure pocket (2) of the hand protector extends to substantially cover the area of the back of the hand.

What is claimed is:

1. A glove comprising:

(A) an outer layer comprising (i) a plurality of first individual pocket enclosures wherein each first individual pocket enclosure is positioned on the back portion of a hand between a knuckle and a first finger joint adjacent to the knuckle;

(ii) a plurality of second individual pocket enclosures wherein each second individual pocket enclosure is positioned on the back portion of the hand on each finger between a first joint and a second finger joint adjacent to the distal end of the finger and on the thumb between the first finger joint and the distal end of the thumb;

(ii) a third individual pocket enclosure that substantially covers the back of the hand; and (B) an inner layer positioned within the first, second and third individual pocket enclosures, wherein the inner layer comprises (i) a high strength, lightweight, impact resistant material that is contoured to cover the back portion of the hand and (ii) a layer of padding on each side of the high strength, lightweight, impact resistant material.

2. The glove of claim 1 wherein the high strength, lightweight, impact resistant material is titanium, aluminum, steel, nylon, leather, hard plastic or similar impact material.

3. The glove of claim 2 wherein the high strength, lightweight, impact resistant material dissipates impact force.

4. The glove of claim 1 wherein the high strength impact, impact resistant material within the respective first, second and third enclosure pockets is stitched permanently.

* * * * *